US005184829A

United States Patent [19]

Njaka

[11] Patent Number: 5,184,829

[45] Date of Patent: Feb. 9, 1993

[54] GAME APPARATUS AND METHOD

[76] Inventor: Dim Njaka, 7300 France Ave. South, Suite 450, Edina, Minn. 55435

[21] Appl. No.: 775,280

[22] Filed: Oct. 11, 1991

[51] Int. Cl.[5] ..... A63F 3/00

[52] U.S. Cl. ..... 273/242

[58] Field of Search ..... 273/242, 261, 280, 283, 273/284, 281, 282, 287

[56] References Cited

U.S. PATENT DOCUMENTS

| | | | |
|---|---|---|---|
| 1,714,127 | 5/1929 | Graham | 273/282 C X |
| 2,292,219 | 8/1942 | Escuadra | 273/242 |
| 2,319,159 | 5/1943 | Salomon | 273/242 |
| 3,170,696 | 2/1965 | Nielsen | 273/282 C X |
| 3,211,458 | 10/1965 | Walls et al. | 273/248 |
| 4,142,728 | 3/1979 | Balduman | 273/242 |
| 4,961,583 | 10/1990 | Koch et al. | 273/287 X |
| 4,984,807 | 1/1991 | Shiryon | 273/284 X |

FOREIGN PATENT DOCUMENTS

| | | | |
|---|---|---|---|
| 476480 | 12/1937 | United Kingdom | 273/242 |
| 2155794 | 10/1985 | United Kingdom | 273/242 |
| 2203956 | 11/1988 | United Kingdom | 273/242 |
| 2228875 | 12/1990 | United Kingdom | 273/242 |

OTHER PUBLICATIONS

"Wari", *Games of the World*, 1975, pp. 20–25.

*Primary Examiner*—V. Millin
*Assistant Examiner*—William E. Stoll
*Attorney, Agent, or Firm*—Palmatier, Sjoquist & Helget

[57] ABSTRACT

A game apparatus with a circular base and concave depressions formed around the periphery of the base for engaging cup-like receptacles. The receptacles are removable from the depressions via notches formed in the base for receiving fingertips. Game pieces are moved around the receptacles in accordance with the method of playing the game for capturing game pieces and exchanging respective receptacles.

16 Claims, 1 Drawing Sheet

GAME APPARATUS AND METHOD

BACKGROUND OF THE INVENTION

The present invention relates to game boards and, more particularly, to game boards on which game pieces are moved peripherally about the board.

The definition of a successful board game may be one that is enjoyed by all ages and abilities. For example, the game of checkers is sufficiently simple for the young, but sufficiently complex for being the subject of numerous books and world championships. Hence, the features of simplicity and complexity may coexist in a board game.

Chess is an example of a board game that may sacrifice simplicity for complexity. Outside of the most extreme cases, it fails to attract the very young. Even adults may be easily turned off by chess, perhaps in view of its high learning threshold.

Another attribute of a successful board game may be aesthetic appeal. One aesthetic feature may be a particular symmetry such that the board game provides the same perspective to all players. The games of checkers and chess provide this feature both in the game board and in the game pieces themselves.

SUMMARY OF THE INVENTION

An object of the present invention is to provide a complex, yet relatively simple board game.

Another object of the present invention is to provide a board game with a relatively low learning threshold and simple rules.

Another object of the present invention is to provide a board game with endless possibilities and combinations and potentially complex maneuvers.

Another object of the present invention is to provide an aesthetically appealing board game.

A feature of the present invention is an integral circular base forming a circular path of concave depressions about its perimeter. Movement of game pieces occurs along this circular path, and the game pieces are located in cup-like receptacles, which are in turn engaged by the concave depressions. The cup-like receptacles are color-coded to identify their owners. The players capture the game pieces when the amount of game pieces in a receptacle reaches a predetermined number.

An advantage of the present invention is that it is playable by persons of practically all ages and abilities. In order to play the game, only the ability to count to the predetermined number, such as four, is required. However, with advanced players, the winner typically possesses great foresight, an ability to compute quickly, and a knack for taking care of the placement of his or her own pieces instead of taking a chance on the various outcomes of the possible moves by his or her opponents.

Another advantage of the present invention is that it is aesthetically appealing. One feature contributing to this advantage is the symmetry of the base of the game board and the identical perspective which it offers to each of the players.

DETAILED DESCRIPTION OF THE PREFERRED EMBODIMENTS

Figure 1:
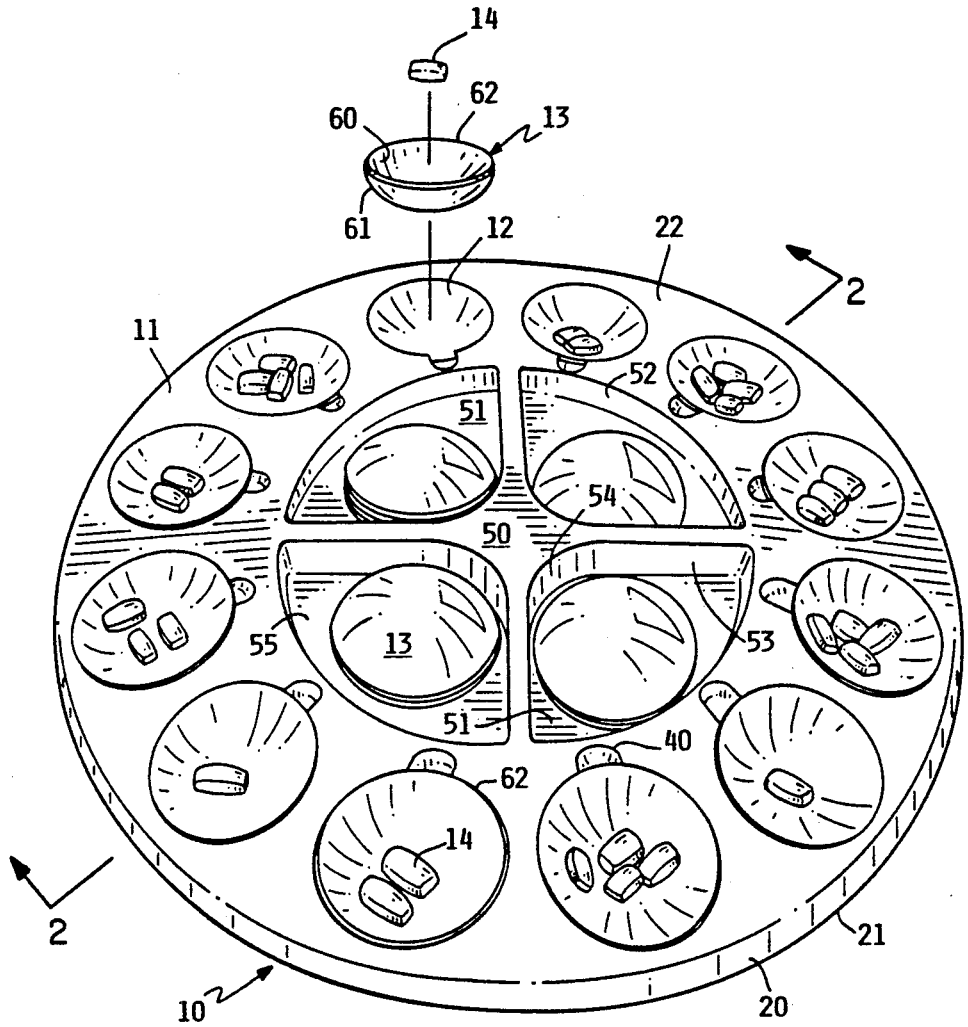
FIG. 1 is a perspective, partially exploded view of the present game apparatus.

As shown in FIG. 1, the present game apparatus is indicated in general by the reference numeral 10. It includes as its principal components an integral base 11, a plurality of twelve concave depressions 12 formed in the base 11, a plurality of cup-like receptacles 13 for placement in the depressions 12, and a plurality of game pieces 14 for placement in the receptacles 13.

Figure 2:
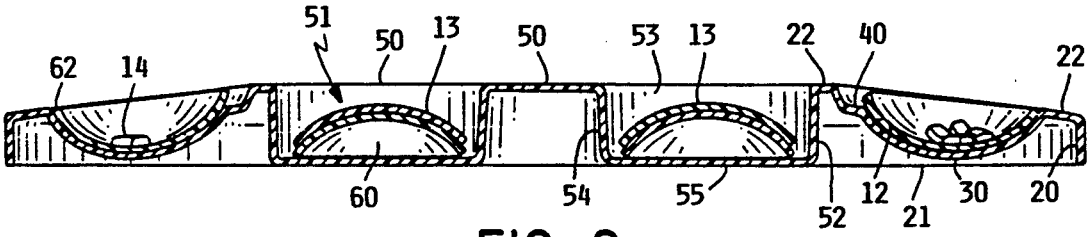
FIG. 2 is a section view at lines 2—2 of FIG. 1.

In more particularity, as shown in FIGS. 1 and 2, the base 11 is circular and includes an upright wall 20 defining a circular border. The upright border wall 20 includes a bottom circular edge 21. Disposed inwardly of the upright wall 20 is a circular band 22. The band 22 is formed at an obtuse angle relative to the wall 20 and hence defines a tapering portion of the base 11.

The concave depressions 12 are formed in the peripheral band 22 and are disposed equidistant from each other. Each of the concave depressions 12 includes a lowermost portion 30 which is spaced slightly above the bottom edge 21 of the upright wall 20. The depressions 12 may be referred to as retainment means for retainment the game pieces 14 via the receptacles 13.

A plurality of notches 40 are formed in the base 11 immediately inwardly of the depressions 12 for receiving fingertips for easy removal of the cup-like receptacles 13 from the depressions 12. Each of the notches 40 reflect the shape of a fingertip to communicate its purpose to the players of the board game. Each of the notches 40 leads into its respective depression 12 and is positioned radially relative to the center of the base 11, its respective depression 12, and the circular upright wall 21.

A central region 50 is formed centrally in the base 11 in generally the shape of an "X". The central region 50 defines four cavities 51 for storing the cup-like receptacles 13 and the game pieces 14. Each of the cavities 51 includes an upright sidewall 52 running coaxially with the circular border wall 21. Each of the cavities 51 further includes a pair of inwardly and radially extending sidewalls 53 which intersect each other at a curved sidewall portion 54. Each of the cavities further includes a flat floor disposed substantially in the same plane as the bottom edge 21 of the border wall 20. The central region 50 also lies substantially in one plane and lies parallel to each of the floors 51.

Each of the receptacles 13 is generally cup-like in shape and includes an interior concave face 60 for holding game pieces 14 and an opposing, parallel exterior convex face 61 for confronting the depressions 12. The faces 60, 61 define a thickness of the receptacle 13. The depth of each of the receptacles 13 is approximately equal to the depth of each of the depressions 12; the depth of each of the receptacles 13 is slightly less than the depth of the depressions by the thickness of the receptacle 13 so that a circular edge 62 of each of the receptacles 13 lies flush with the surface of the peripheral region 22 when the receptacle 13 lies in one of the depressions 12. When stacked in the cavities 51, the receptacles 13 are typically disposed face down; the circular edge 62 of the bottom-most stacked receptacle 13 engages the floor 55 of the respective cavity 51. The receptacles 13 may be referred to as identification means for identifying ownership of each of the depressions 12.

Each of the game pieces 14 is slightly elongate with six faces. Each of the pieces 14 is typically solid and typically is of a color different from the base 11 or any of the receptacles 13.

Code means for identifying the receptacles 13, and thus the depressions 12, owned by different players typically includes a color code scheme. Each of the receptacles is typically colored in one of four different colors. Four sets of receptacles 13 are preferably provided with each of the sets being of a different color.

It should be noted that the base 11 may be formed in an octagon or diamond shape. It should be further noted that the base 11, although preferably vacuum formed, may be injection molded or be formed from a solid such as Corean, marble, or Avonite.

In the method of playing the game, the game may be played by two, three or four players. The equipment for the game typically includes the playing board or base 11 with the twelve concave depressions 12, four differently-colored groups of ten receptacles 13 apiece for a total of 40 possession cups or receptacles, and forty-eight plexis or game pieces 14. The object of the game is to accumulate more sets of four game pieces 14 than your opponent or opponents. One set is defined as four game pieces 14.

In the initial setup of the game, the twelve depressions 12 are divided into equal contiguous or adjoining sections among the players. After choosing a set of colored cups, a player identifies his or her contiguous section by inserting one receptacle 13 in each of the concave depressions 12 of his or her contiguous section. Four game pieces 14 are then placed in each of the twelve receptacles 13 to complete the initial setup.

Play is initiated by mutual agreement. If agreement cannot be reached, play is initiated by the player whose weight is closest to 444 pounds. The first player then begins play by choosing any one of his receptacles 13 and distributing therefrom the game pieces 14 counterclockwise (or clockwise if desired). In such a distribution, one game piece 14 from the chosen receptacle 13 is placed into each successive receptacle 13. If the last game piece 14 in a player's hand lands in a receptacle 13 already containing game pieces 14, the player must either collect all of the game pieces in that receptacle 13 and continue distribution of the game pieces 14 in the same direction until the player's "hand" ends on a previously-empty receptacle 13 or end the player's turn if the player forms a "new" set of four game pieces 14 with the last game piece 14 (a capture).

Play continues from right to left (or from left to right). Each of the players in turn must select any one of his or her game-piece-filled-receptacles 13 for distribution or forfeits his or her turn if all of his or her receptacles 14 are empty. It should be noted that the first play of the game will travel around the base 21 at least two times before a player's hand ends in an empty receptacle 13. Thus, the present game is not unlike the game of pool, where the first player "breaks-up" the stacked balls with the cue to begin play. The first play of the present game breaks-up the board to create "pockets" of opportunities for capturing new sets of game pieces 14.

A player can capture a set of four game pieces 14 in one of three ways. First, a passing hand (a hand distributing game pieces 14) of anyone forms a set of four game pieces 14 in his or her receptacle 13; here, the cup owner, not necessarily the distributor, takes possession of the set of four game pieces 14. Second, a distribution by a player ending in a receptacle 13 that forms a new set of four game pieces 14; this player's turn ends with him or her taking possession of this set (collecting the game pieces 14 from the receptacle 13) of four game pieces irrespective of the owner of the receptacle 13. Third, the first player to say "4 Plex" after the capture of the eleventh set of game pieces 14 claims the twelfth and final set of four game pieces 14.

When a set of four game pieces 14 is captured, it is removed from the base 21 and becomes the property of the captor. The newly-emptied receptacle 13 remains in its respective depression 12 for receiving still further game pieces 14.

The game includes short and long forms. In its short form, the first player to have a two set advantage at the end of a round or game wins. Or, it may be agreed that the winner is the player who owns a majority of the sets after a round or game. This is called default play. In its long form, one of the numbers 3, 4 or 5 is selected at the onset of the game. The first player to have an advantage of sets equaling the selected number wins.

If there is no winner at the end of each round of the game, the game will continue with the next player's turn until one player wins. The number of a player's receptacles 13 to be placed on the base 11 at the beginning at each successive round is equal to the number of sets of game pieces 14 captured by him or her in the previous round.

The game includes some miscellaneous rules. Players are not allowed to physically count the game pieces 14. Once in play, a turn cannot be changed (touch-n-play). For example, if a player touches one of his receptacles 13 or its respective notch 40, or a game piece 14 in such a receptacle 13, the player must distribute the respective game pieces 14. If a player fails to remove a new set of four game pieces 14 before it is overlaid by a passing hand, he or she must forfeit that set. The first player to yell "4 Plex" after the capture of the eleventh set of game pieces 14 claims the last set of game pieces 14. In the event of a tie or default or predetermined agreement, the player that captured the eleventh set of game pieces 14 claims the twelfth or last set of game pieces 14. A timer can be used to discourage counting or delay play.

For an advanced two-player game, all the rules of the regular game may apply except that instead of a contiguous division of the concave depressions 12, the two players' colored receptacles 13 may be alternately placed around the peripheral band 22. Furthermore, play may proceed either clockwise or counterclockwise. Still further, upon the capture of a set of four game pieces 14 from an opponent's receptacle 13 or engagement means 12, the captor not only collects all the game pieces 14 in that receptacle 13, but may replace the receptacle 13 with one of his or her own receptacles 13 to identify that depression or engagement means 12 as being owned by him or her.

The development of a stratagem that prevents your opponent or opponents from capturing more sets than you in the later stages of the game may be the key to winning most games. For example, it may be helpful to determine the possibilities of capturing your opponent's set or sets, to determine the possibilities of completing a set or sets in your own receptacles 13, to contemplate the effects of your actions several moves ahead, and to try to position your game pieces 14 in your receptacles 13 in such a way that you can form a set without your opponent or opponents effecting your moves.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A game apparatus comprising:

a) a base having a periphery;

b) a plurality of game pieces for being distributed about the periphery of the base;

c) a plurality of depressions disposed about the periphery of the base for retaining the game pieces, the game pieces being readily visible when retained by the depressions, wherein each of the depressions comprises a concave portion; and d) a plurality of color-coded receptacles for identifying ownership of each of the depressions, each of the receptacles having opposing faces, one of the faces being concave, the other face being convex, and the convex face of each of the receptacles being engageable with the concave portion of each of the depressions, the receptacles thereby being removably engageable within each of the depressions.

2. The game apparatus of claim 1, and further comprising storage means on the base for engaging and storing the color-coded receptacles and game pieces.

3. The game apparatus of claim 2, wherein the storage means comprises a cavity disposed inwardly of the periphery.

4. The game apparatus of claim 3 and including at least four cavities formed in the base.

5. The game apparatus of claim 4, wherein each of the cavities includes three sides, one of the sides being curved and adjacent to the depressions, the other two sides extending inwardly from the depressions to intersect adjacent to a central region of the base.

6. The game apparatus of claim 1, wherein each of the depressions further comprises a notch leading into its respective concave portion for receiving the tip of a finger for easy removal of the receptacles from their respective depressions.

7. The game apparatus of claim 1, wherein each of the receptacles and each of the depressions have approximately a common depth.

8. A game apparatus comprising:

a) an integral base having a peripheral band and a circular border;

b) a plurality of circular concave depressions formed in the peripheral band of the base;

c) a plurality of circular receptacles for placement in the depressions, each of the receptacles having a convex face and a concave face, each of the receptacles being removably engagable in each of the depressions such that the convex face of each of the receptacles is confrontable with each of the concave depressions;

d) a set of at least four cavities formed in the base inwardly of the periphery for storing the receptacles, each of the cavities having a width greater than each of the receptacles; and e) a plurality of game pieces for placement in the receptacles, each of the game pieces being of a size smaller than each of the receptacles.

9. The game apparatus of claim 8 and further comprising a plurality of notches, each of the notches leading into one of the concave depressions for receiving the tip of a finger for easy removal of the receptacles from their respective depressions.

10. The game apparatus of claim 8, wherein each of the receptacles and each of the depressions have approximately a common depth.

11. The game apparatus of claim 8, wherein each of the cavities includes an outer curved side, the outer curved sides being coaxial with the circular border.

12. The game apparatus of claim 11, and the cavities being defined in part by the peripheral band and a central region forming generally the shape of an "X".

13. The game apparatus of claim 8, and the peripheral band of the base being tapered.

14. A game apparatus comprising:

a) a base having a circular peripheral band, a circular border, and a central region forming generally the shape of an "X", the peripheral band being tapered, the circular border being formed by an upright wall, the band, border, and central region being integral such that the base is in one piece;

b) a plurality of at least twelve circular concave depressions formed in the peripheral band of the base, the depressions formed in a circle and being spaced equidistant from each other, each of the depressions having a depth;

c) a plurality of at least twelve circular receptacles for placement in the depressions, each of the receptacles having a convex face and a concave face which run parallel to each other, each of the receptacles having a depth defined by its concave face, each of the receptacles having a circular edge, each of the receptacles having a thickness defined by the distance between its concave and convex faces, each of the receptacles being removably engagable in each of the depressions such that the convex face of each of the receptacles is confrontable with each of the concave depressions, the sum of the depth of each of the receptacles and their respective thicknesses being equal to the depth of each of the depressions such that each of the circular edges is approximately flush with the peripheral band;

d) a plurality of notches, each of the notches leading into one of the concave depressions for receiving the tip of a finger for easy removal of the receptacles from their respective depressions, each of the notches disposed inwardly of its respective depression;

e) a set of at least four cavities disposed inwardly of the peripheral band in the central region for storing at least the receptacles, each of the cavities having a width greater than each of the receptacles, each of the cavities including an outer curved side, the outer curved sides being coaxial with the circular border; and f) a plurality of game pieces for placement in the receptacles, each of the game pieces being of a size smaller than each of the receptacles and at least four game pieces being engagable in one of the receptacles at the same time.

15. A method for playing a game for two or more players in combination with a game apparatus, the combination comprising:

a) the game apparatus comprising:

1) a base having an endless path;

2) a plurality of game pieces for being distributed along the endless path;

3) a plurality of retainment means on the endless path for retaining the game pieces, the game pieces being readily visible when retained by the retainment means; and 4) a plurality of identification means for identifying ownership of each of the retainment means, each of the identification means being removably engageable with each of the retainment means, each of the players owning a respective set of possession identification means;

b) the method of playing the game comprising:

1) setting up the game by engaging each of the retainment means with one possession identification means and by placing a given number of game pieces within each of the retainment means;

2) then one of the players choosing a chosen retainment means identified by one of his or her identification means and then beginning to distribute the game pieces of the chosen retainment means one by one into retainment with successive retainment means along the endless path;

3) then distributing the last game piece from the chosen retainment means into retainment with a last successive retainment means and then:

i) capturing the game pieces from the last successive retainment means if the last successive retainment means includes the given number of game pieces and thereby the player distributing the game pieces completing his or her turn; or ii) forming a set of one game piece on the last successive retainment means and thereby the player distributing the game pieces completing his or her turn; or iii) forming a set of two or more game pieces, except the given number of game pieces, on the last successive retainment means and thereby requiring the player distributing the last game piece to continue his or her turn by further distributing the game pieces from the last successive retainment means until the set of one game piece is formed or until the given number of game pieces is formed in the last successive retainment means in which case the game pieces are captured therefrom;

4) capturing the game pieces from one of the possession retainment means by the given number being formed by a retainment of any of the game pieces, other than the last game piece being distributed, with one of the possession retainment means, the game pieces of which are then captured by the player owning the possession retainment means; and c) winning a round of the game by capturing more game pieces than any of the other players, the game being completed when the game pieces from the next-to-last noncaptured retainment means are captured, the game pieces from the last remaining retainment means being captured by a predetermined capture agreement.

16. The method of claim 15, wherein the predetermined capture agreement comprises capturing the game pieces from the last remaining engagement means by capturing the game pieces from the next-to-last noncaptured engagement means whereby the player who captures the game pieces from the next-to-last noncaptured engagement means captures the game pieces from the last remaining engagement means.

* * * * *

UNITED STATES PATENT AND TRADEMARK OFFICE

CERTIFICATE OF CORRECTION

PATENT NO. : 5,184,829

DATED : February 9, 1993

INVENTOR(S) : Dim Njaka

It is certified that error appears in the above-identified patent and that said Letters Patent is hereby corrected as shown below:

Column 2, line 24, "retainment" should be -- retaining --.

Signed and Sealed this

Eleventh Day of January, 1994

*Attest:*

*Attesting Officer*

BRUCE LEHMAN

*Commissioner of Patents and Trademarks*